United States Patent [19]

Bähr et al.

[11] 4,131,563

[45] Dec. 26, 1978

[54] PROCESS OF PREPARING SUBSTANTIALLY SOLID WASTE CONTAINING RADIOACTIVE OR TOXIC SUBSTANCES FOR SAFE, NON-POLLUTIVE HANDLING, TRANSPORTATION AND PERMANENT STORAGE

[75] Inventors: Werner Bähr, Speyer; Stefan Drobnik, Blankenloch; Werner Hild, Hochstetten; Reinhard Kroebel, Leopoldshafen; Alfred Meyer, Cologne; Günter Naumann, Leverkusen, all of Germany

[73] Assignee: Steag Kernenergie G.m.b.H., Essen, Germany

[21] Appl. No.: 717,552

[22] Filed: Aug. 25, 1976

Related U.S. Application Data

[63] Continuation of Ser. No. 534,773, Dec. 20, 1974, abandoned.

[30] Foreign Application Priority Data

Dec. 20, 1973 [DE] Fed. Rep. of Germany ..... 2363475

[51] Int. Cl.[2] ..... G21F 9/34

[52] U.S. Cl. ..... 252/301.1 W

[58] Field of Search ..... 252/301.1 W

[56] References Cited

U.S. PATENT DOCUMENTS

| | | | |
|---|---|---|---|
| 3,723,338 | 3/1973 | Godfrey | 252/301.1 W |
| 3,838,061 | 9/1974 | Cuaz et al. | 252/301.1 W |

OTHER PUBLICATIONS

Erben, M. T. et al., "Polymer–encapsulation of activities. . ." as abstracted in *Chemical Abstracts,* vol. 71, abstract No. 738356 (1969).

*Primary Examiner*—Benjamin R. Padgett
*Assistant Examiner*—Deborah L. Kyle
*Attorney, Agent, or Firm*—Sprung, Felfe, Horn, Lynch & Kramer

[57] ABSTRACT

A process of preparing substantially solid wastes containing radioactive or toxic substances for safe, non-pollutive handling, transportation and permanent storage, wherein the wastes are mixed with polymerizable mixtures consisting essentially of monovinyl and polyvinyl compounds and polymerization catalysts, and are converted by polymerization into solid blocks.

11 Claims, No Drawings

PROCESS OF PREPARING SUBSTANTIALLY SOLID WASTE CONTAINING RADIOACTIVE OR TOXIC SUBSTANCES FOR SAFE, NON-POLLUTIVE HANDLING, TRANSPORTATION AND PERMANENT STORAGE

CROSS-REFERENCE TO RELATED APPLICATION

This application is a continuation of application Ser. No. 534,773 filed Dec. 20, 1974 and now abandoned.

This invention relates to a process of preparing substantially solid waste containing radioactive or toxic substances for safe, non-pollutive handling, transportation and permanent storage, the solids being brought into contact with hardening materials and left to harden into solid masses.

It is already known that highly toxic or radioactive waste accumulates in industry, especially in the nuclear industry, and in cases where it is to be stored or transported it has to be treated to prevent it from entering the biocycle.

It is known that solid waste of this kind, for example precipitation sludges, spent ion exchangers, ashes and incineration residues, metal cuttings, etc., can be stored in containers (Management of low and intermediate level radioactive wastes; Proceedings of a Symposium Aix-en-Provence, 7th–11th Sept. 1970; IAEA, Vienna, 1970), or mixed with cement slurry and then stored embedded in cement. Storage in containers has been found to entail problems in view of corrosion phenomena affecting the containers. Disadvantages of embedding in cement include the large volumes of waste which this involves, the poor setting properties of cement with respect to the wastes to be embedded, and the inadequate extraction behaviour of the wastes embedded in the cement.

The object of the invention is to provide a process which does not have any of the disadvantages of conventional processes and in which radioactive or toxic solid wastes, or solid wastes containing radioactive or toxic substances, can be irreversibly solidified into blocks or the like with relatively high resistance to extraction and washing out. The solid wastes are intended to be able to be solidified with equal effect whether used in dry form or in admixture with water, aqueous solutions or organic liquids or organic solutions. The process is intended to be able to be carried out inexpensively by only briefly trained personnel and without appreciable outlay on plant. It is intended to provide non-pollutive solidification products which can be handled safely and transported safely to a permanent storage site.

According to the invention, this object is achieved by virtue of the fact that the wastes are mixed with polymerisable mixtures consisting essentially of monovinyl and polyvinyl compounds and polymerisation catalysts, and converted by polymerisation into solid blocks.

The following represent suitable monovinyl compounds: styrene, methyl styrene, acrylic acid, methacrylic acid, acrylonitrile, acrylic acid esters, methacrylic acid esters, vinyl anisole, vinyl naphthalene, methyl acrylate, ethyl acrylate, propyl acrylate, isopropyl acrylate, butyl acrylate, tert.-butyl acrylate, ethyl hexyl acrylate, cyclohexyl acrylate, isobornyl acrylate, benzyl acrylate, phenyl acrylate, alkyl phenyl acrylates, ethoxy methyl acrylate, ethoxy ethyl acrylate, ethoxy propyl acrylate, propoxy methyl acrylate, propoxy ethyl acrylate, propoxy propyl acrylate, ethoxy phenyl acrylate, propyl methacrylate, isopropyl methacrylate, butyl methacrylate, tert.-butyl methacrylate, ethyl hexyl methacrylate, cyclohexyl methacrylate, isobornyl methacrylate, benzyl methacrylate, phenyl methacrylate, alkyl phenyl methacrylate, ethoxy methacrylate, ethoxy ethyl methacrylate, ethoxy propyl methacrylate, propoxy methyl methacrylate, propoxy ethyl methacrylate, propoxy propyl methacrylate, ethoxy phenyl methacrylate, ethoxy benzyl methacrylate, vinyl toluene, vinyl chloride, vinyl acetate and vinylidene chloride. Polyethylenically unsaturated monomers such as isoprene, butadiene and chloroprene can also be used.

It is also possible to use heterocyclic monovinyl compounds such as vinyl pyridine, 2-methyl-5-vinyl pyridine, 2-ethyl-5-vinyl pyridine, 3-methyl-5-vinyl pyridine, 2,3-dimethyl-5-vinyl pyridine, 2-methyl-3-ethyl-5-vinyl pyridine, 2-methyl-5-vinyl quinoline, 4-methyl-4-vinyl quinoline, 1-methyl or 3-methyl-5-vinyl isoquinoline and vinyl pyrrolidone.

Styrene, vinyl toluene and methyl acrylate are particularly preferred.

The following represent suitable polyvinyl compounds: divinyl benzene, divinyl, pyridine, divinyl toluenes, divinyl naphthalenes, diallyl phthalate, ethylene glycol diacrylate, ethylene glycol dimethacrylate, divinyl xylene, divinyl ethyl benzene, divinyl sulphone, polyvinyl or polyallyl ethers of glycol, glycerol and pentaerythritol, divinyl ketone, divinyl sulphide, allyl acrylate, diallyl maleate, diallyl fumarate, diallyl succinate, diallyl carbonate, diallyl malonate, diallyl oxalate, diallyl adipate, diallyl sebacate, divinyl sebacate, diallyl tartrate, diallyl silicate, triallyl tricarballylate, triallyl aconitrate, triallyl citrate, triallyl phosphonate, N,N'-methylene diacryl amide, N,N'-methylene dimethacryl amide, N,N'-ethylene diacryl amide, 1,2-di-(α-methyl methylene-sulphonamido)-ethylene, trivinyl benzene, trivinyl naphthalene and polyvinyl anthracenes.

Divinyl benzene and trivinyl benzene are particularly preferred.

Any wastes, advantageously wastes of the kind whose physical and chemical properties represent a threat to the environment, are suitable for inclusion in the polymers. The process according to the invention can be applied to radioactive or toxic wastes which in nuclear engineering for example are contaminated by radioactivity by being used in the preparation or separation of radioactive substances or in the cleaning of the apparatus used.

The following are mentioned as examples of wastes contaminated with radioactivity:

- active carbon, for example from waste-air filter plants, from the after-purification of evaporator condensates or the like;
- ashes, for example from incineration plants for burnable radioactive wastes;
- metal swarf, for example from the production of fuel elements and from the machining of contaminated plant and equipment;
- precipitation sludges, for example from the chemical treatment of radioactive effluent;
- parts of apparatus, for example from the maintenance of contaminated plant and equipment;
- deposits, for example emanating from the storage of radioactive waste solutions;
- deposits, for example produced in storage containers, pipelines, pumps or the like for radioactive solutions;

and spent ion exchangers, for example from the purification of water circuits in nuclear reactors and fuel element storage vessels contaminated with radio activity.

Toxic wastes include compounds of cadmium and arsenic, cyanides, chromium compounds, mercury and its salts, tin and antimony compounds, thallium compounds, solid wastes with plant protection agents, insecticides, fungicides, stomach poisons and the like. It is possible to solidify both dry wastes and also wastes in admixture with water or aqueous and organic liquids or organic solutions.

The solid wastes are preferably used in quantities of from 2% to 75% by weight and more preferably in quantities of from 30% to 70% by weight, based on the total weight of the wastes + polymerisation mixture. The monovinyl compounds are preferably used in quantities of from 70% to 99.5% by weight and more preferably in quantities of from 85% to 99% by weight, based on the weight of the monomers. The polyvinyl compounds are preferably used in quantities of from 0.5% to 30% by weight and more preferably in quantities of from 1% to 15% by weight based on the weight of the monomers. The polymerisation catalysts are preferably used in quantities of from 0.1% to 6% by weight and more preferably in quantities of from 0.3% to 4% by weight, based on the weight of the monomers.

Emulsifiers and/or swellable or absorbent solids are adventageously added to solid wastes containing water or aqueous solutions before they are mixed with the polymerisation mixture (monomer mixture).

Particularly suitable emulsifiers include anion-active surfactants, more especially alkyl sulphonates, alkyl and aryl benzene sulphonates, and non-ionic surfactants, more especially ethoxylated and propoxylated fatty alcohols, fatty acids and fatty amines.

Swellable or absorbent solids in the context of the invention are carrier substances which, by virtue of their physical structure, are able to take up water. Swellable solids are organic adsorbents, primarily macroporous crosslinked copolymers of the type described, for example, in British Patent 1.129.125 (=US-Patent 3.531.463) more especially ion exchangers. Absorbent substances also include inorganic gels, for example silica gel, alumina gel or kieselguhr, zeolites and, in particular, vermiculite.

Absorbents are advantageously added to the solid wastes in admixture with organic liquids or organic solutions before they are mixed with the polymerisation mixture. Vermiculite or macroporous styrene-divinylbenzene copolymers are used as absorbents.

In the process according to the invention there can be used as solid wastes also swellable or absorbent solids which have been impregnated with radio active or toxic liquids. In this manner also radio active or toxic liquids can be worked up according to the invention.

The following are examples of radioactive liquids:

1. Radioactive aqueous solutions and sludges, for example evaporated concentrates from the evaporation of radioactive waste solutions, precipitation sludges from the chemical precipitation treatment of radioactive waste solutions, precipitates and deposits from the storage of radioactive liquids and the like.

2. Waste liquors of the kind accumulating during the working up of fuel element residues, for example highly concentrated neutral nitrate solutions.

3. Radioactive extractants, for example of the type accumulating during the working up of radioactive residues by liquid-liquid extraction, for example tributyl phosphate and acid di-ethyl hexyl phosphoric acid esters.

4. Organic auxiliary liquids of the type used in nuclear installations, for example machine oils, pump oils, vacuum oils, fats, waxes and soaps.

The following are examples of toxic liquids: solutions of cadmium and arsenic compounds, cyanide solutions, chromate solutions, mercury and its salt solutions, solutions of tin, antimony and thallium compounds, solutions containing plant protection agents, insecticides fungicides and stomach poisons.

In cases where moist solids are used, it is advantageous slightly to increase the proportion of monomer so that the soldid wastes are present in an amount of 30% to 60% by weight based on the total weight of solid wastes + polymerisation mixture.

The polymerisation catalysts used are known, the following being mentioned by way of example:

acetyl peroxide, benzoyl peroxide, tert.-butyl hydroperoxide, cumene peroxide, lauroyl peroxide, azodiisobutyrodinitrile, methyl ethyl ketone peroxide, tetralin peroxide and persulphates.

It is preferred to use catalysts with a low initiation temperature, for example azodiisobutyrodinitrile.

The process according to the invention is generally carried out by adding the solid waste preferably without stirring in portions to a polymerisation mixture of the monovinyl compound, the polyvinyl compound and the polymerisation catalyst and keeping the mixture without external heating. By the energy evolved by the polymerisation the temperature of the mixture raises to about 30 to 70° C. After the heat effect has disappeared, the material is hard and the radioactive or toxic solid is included in the polymer. The mixtures to be polymerised generally harden after 2 to 20 days to from a solid block. They may be left with advantage in the polymerisation can be carried principally at temperatures from 15 to 150° C.

Since radioactive and toxic solids are advantageously included without further admixture in the containers in which the wastes are permanently stored, a high degree of reliability is obtained by virtue of the limited outlay on plant. The process according to the invention can be applied to any solids even if they have a high liquid content.

EXAMPLE 1

60 kg of radioactive vessel ashes from an incineration plant for burnable radioactive wastes are introduced in portions at 25° C. into a solution of 21.55 kg of styrene, 0.75 kg of divinyl benzene (60% by weight) and 0.7 kg of azodiisobutyronitrile accommodated in a 200 litre-capacity container. The mixture hardens after 2 days at 45° C. It is completely solid after 5 days.

EXAMPLE 2

50 kg of a moist, radioactive mixed-bed exchanger consisting of an anion exchanger based on a polyvinyl trimethyl ammonium hydroxide crosslinked with 4% of divinyl benzene and a cation exchanger based on polystyrene sulphonic acid crosslinked with 8% of divinyl benzene in an equivalent ratio, are introduced at 20° C. into a solution of 56.2 kg of styrene, 2.0 kg of divinyl benzene (60% by weight) and 1.8 kg of azodiisobutyronitrile accommodated in a 200 litre-capacity container. The mixture hardens after 2 days at 35° C. It is completely solid after 6 days.

EXAMPLE 3

80 kg of a moist, radioactive strongly basic anion exchanger based on a polyvinyl benzyl trimethyl ammonium hydroxide crosslinked with 4% by divinyl benzene are introduced at 22° C. into a solution of 93.7 kg of styrene, 3.3 kg of divinyl benzene (60% by weight) and 3.0 kg of azodiisobutyronitrile accommodated in a 200 litre-capacity container. The Mixture hardens after 3 days at 30° C. It is completely solid after 6 days.

EXAMPLE 4

58 kg of styrene, 2 kg of divinyl benzene (60%), 3 kg of azodiisobutyrodinitrile and 6 kg of an oleyl alcohol reacted with 18 mols of ethylene oxide, are successively introduced at 25° C. into a 200 litre-capacity container. A homogeneous solution is prepared by manual stirring. 100kg of a water-swollen, radioactive strongly acid cation exchanger based on polystyrene sulphonic acid crosslinked with 8% of divinyl benzene, are then introduced into this solution. The mixture hardens after 4 days at 50° C. It is completely solid after 14 days.

EXAMPLE 5

(A). Swelling a radioactive solution into a dried ion exchanger 120 kg of a radioactive, approximately 30% by weight sodium nitrate solution are introduced into a 200 litre-capacity vessel, followed by the addition of 45 kg of a dried, strongly acid cation exchanger based on polystyrene sulphonic acid crosslinked with 2% of divinyl benzene.

The resin is left for 8 hours to swell in the solution, the swollen resin is filtered off under suction and the moist product is used for block polymerisation.

(B). Block polymerisation 58 kg of styrene, 2 kg of divinyl benzene (60% by weight), 3 kg of azodiisobutyrodinitrile and 6 kg of an oleyl alcohol reacted with 18 mols of ethylene oxide are successively introduced at 20° C. into a 200 litre-capacity container. A homogeneous solution is prepared by manual stirring. 135 kg of the resin containing sodium nitrate as prepared in (A) and 9 kg of a dried strongly acid cation exchanger based on polystyrene sulphonic acid crosslinked with 2% of divinyl benzene, are introduced into this solution in portions using a metering system. The mixture hardens after 3 days at 45° C. It is completely solid after about 4 weeks.

EXAMPLE 6

(A). Swelling a radioactive solution into vermiculite 50 kg of a radioactive 30% sodium nitrate solution are introduced at 24° C. into a 200 litre-capacity vessel followed by the addition of 9 kg of vermiculite. The vermiculite is left to swell for at least an hour, after which the swollen material is filtered off under suction and the moist product is used for polymerisation.

(B). Block polymerisation 53 kg of styrene, 2 kg of divinyl benzene (60 % by weight) and 0.3 kg of azodiisobutyronitrile are successively introduced at 20° C. into a 200 litre-capacity vessel. A homogeneous solution is prepared by manual stirring. 39 kg of the product obtained in (A) together with 2 kg of vermiculite are introduced into this solution in portions, optionally using a metering system. The mixture hardens after 4 days at 60° C. It is completely solid after about 4 weeks.

EXAMPLE 7

30 kg of a radioactive pump oil are thoroughly mixed in a container at 20° C. with 50 kg of a bead-form polystyrene crosslinked with 18% of divinyl benzene and made porous with 65% of isododecane (based on the monomer mixture).

The polymer is left to swell for 1 hour, after which a solution of 140.5 kg of styrene, 5.0 kg of divinyl benzene (60% by weight) and 4.5 kg of azodiisobutyrodinitrile is added at a temperature of 22° C. The mixture hardens after 3 days at 35° C. It is completely solid after 12 days.

EXAMPLE 8

37.5 kg of radioactive pump oil are thoroughly mixed for 10 minutes at 20° C. in a 200 litre-capacity container. This is followed by the addition at 24° C. of a solution of 107.7 kg of styrene, 3.8 kg of divinyl benzene (60% by weight) and 3.5 kg of azodiisobutyrodinitrile.

The mixture hardens after 3 days at 35° C. It is completely solid after 8 days.

EXAMPLE 9

50 kg of a 10% by volume radioactive tributyl phosphate solution in isododecane are throughly mixed at 25° C. in a 200 litre-capacity container with 50 kg of a bead-form polystyrene crosslinked with 18% of divinyl benzene and made porous with 65% of isododecane (based on the monomer mixture). The polymer is left to swell for 1 hour, followed by the addition at 25° C. of a solution of 93.7 kg of styrene, 3.3 kg of divinyl benzene (60% by weight) and 3.0 kg of azodiisobutyrodinitrile. The mixture hardens after 3 days at 40° C. It is completely solid after 12 days.

EXAMPLE 10

120.0 kg of radioactive broken glass size-reduced before polymerisation are introduced at 25° C. into a solution of 43.0 kg of styrene, 1.5 kg of divinyl benzene (60% by weight) and 1.4 kg of azodiisobutyrodinitrile accommodated in a 200 litre-capacity container. The mixture hardens into a solid block after 2 days at 40° C. There were no signs of radioaktivity 14 days after extraction with distilled water.

EXAMPLE 11

100.0 kg of calcium orthoarsenate ($Ca_3(As_3O_4)_2$) are introduced at 25° C. into a solution of 43.0 kg of styrene, 1.5 kg of divinyl benzene (60% by weight) and 1.4 kg of azodiisobutyrodinitrile accommodated in a 200 litre capacity container. The mixture hardens after 3 days at 35° C. It is completely solid after 8 days.

EXAMPLE 12

100.0 kg of cadmium sulphate ($CdSO_4$) are introduced at 20° C. into a solution of 43.0 kg of styrene, 1.5 kg of divinyl benzene (60% by weight) and 1.4 kg of azodiisobutyrodinitrile accommodated in a 200 litre-capacity container. At 35° C., the mixture hardens after 4 days and, after 8 days, is in the form of a solid block.

EXAMPLE 13

100.0 kg of a radioactive silica gel (grain size 0.1 to 0.3 mm) of the type accumulating in the purification of kerosene, are introduced at 25° C. into and throughly mixed with a solution of 43.0 kg of styrene, 1.5 kg of divinyl benzene (60% by weight) and 1.4 kg of azodiisobutyrodinitrile accommodated in a 200 litre-capacity container. The mixture hardens after 2 days at 40° C. After 8 days it is in the form of a solid block.

EXAMPLE 14

100 kg of kieselguhr containing 15% by weight of radioactive water are introduced at 25° C. into and thoroughly mixed with a solution of 120 kg of styrene, 4 kg of divinyl benzene, 4 kg of azodiisobutyrodinitrile and 12 kg of the sodium salt of dodecyl benzene sulphonic acid accommodated in a 200 litre-capacity container. The mixture hardens after 4 days at 30° C. It is completely solid after 8 days.

We claim:

1. In the process of preparing substantially solid wastes containing radioactive or toxic substances for safe, non-pollutive handling, transportation and permanent storage, by bringing the solid wastes into contact with hardening materials and hardening the same into solid masses, the improvement wherein the solid wastes are mixed with polymerizable mixtures consisting essentially of styrene selected from the group consisting of divinyl benzene and trivinyl benzene, and polymerization catalysts, and the resulting mixtures are converted by polymerization into solid blocks, the solid wastes being used in quantities of from 2% to 75% by weight, based on the total weight of the wastes + polymerization mixture, the styrene being used in quantities of from 70% to 99.5% by weight, based on the weight of the monomers, the polyvinyl compounds being used in quantities of from 1.0% to 30% by weight, based on the weight of monomers, and the polymerization catalysts being used in quantities of from 0.1% to 6% by weight, based on the weight of the monomers.

2. The process as claimed in claim 1 wherein solid wastes of the kind accumulating in nuclear engineering are included.

3. The process as claimed in claim 1 wherein toxic wastes are included.

4. The process as claimed in claim 1 wherein solid wastes are used in quantities of from 30% to 70% by weight, based on the total weight of the wastes + polymerization mixture, the styrene is used in quantities of from 85% to 99% by weight, based on the weight of the monomers, the polyvinyl compounds are used in quantities of from 1% to 15% by weight, based on the weight of the monomers, and the polymerization catalysts are used in quantities of from 0.3 to 4% by weight, based on the weight of the monomers.

5. The process as claimed in claim 1 wherein emulsifiers are added to solid wastes containing water or aqueous solutions before they are mixed with the polymerizature mixtures.

6. The process as claimed in claim 1 wherein swellable or absorbent solids are added to solid wastes containing water or aqueous solutions before they are mixed with the polymerizable mixtures.

7. The process as claimed in claim 6 wherein dried ion exchangers, inorganic gels, kieselguhr or vermiculite are used as absorbent solids.

8. The process as claimed in claim 7 wherein said inorganic gel is silica gel or alumina gel.

9. The process as claimed in claim 1 wherein absorbents are added to solid wastes containing organic liquids or organic solutions before they are mixed with the polymerizable mixture.

10. The process as claimed in claim 9 wherein vermiculite or macroporous styrene-divinyl benzene copolymers are used as absorbents.

11. The product produced by the process of claim 1.

* * * * *